US011049460B2

(12) United States Patent
Lee et al.

(10) Patent No.: US 11,049,460 B2
(45) Date of Patent: Jun. 29, 2021

(54) DISPLAY DEVICE

(71) Applicant: LG Display Co., Ltd., Seoul (KR)

(72) Inventors: Donggun Lee, Paju-si (KR); Kyujin Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/922,728

(22) Filed: Jul. 7, 2020

(65) Prior Publication Data

US 2021/0043150 A1 Feb. 11, 2021

(30) Foreign Application Priority Data

Aug. 8, 2019 (KR) ..... 10-2019-0096758

(51) Int. Cl.
*G09G 3/3291* (2016.01)
*G09G 3/3266* (2016.01)
*G09G 3/3233* (2016.01)

(52) U.S. Cl.
CPC ..... *G09G 3/3291* (2013.01); *G09G 3/3233* (2013.01); *G09G 3/3266* (2013.01); *G09G 2310/0291* (2013.01); *G09G 2320/0673* (2013.01); *G09G 2330/021* (2013.01)

(58) Field of Classification Search
CPC .. G09G 3/3291; G09G 3/3233; G09G 3/3266; G09G 2310/0291; G09G 2320/0673; G09G 2330/021
See application file for complete search history.

(56) References Cited

U.S. PATENT DOCUMENTS 10,565,931 B2 2/2020 Jung
2016/0049113 A1* 2/2016 Park ..... G09G 3/3266 345/212
2018/0114488 A1 4/2018 Jung
2019/0189038 A1* 6/2019 Park ..... G09G 3/3225

FOREIGN PATENT DOCUMENTS

KR 10-2018-0045902 A 5/2018

* cited by examiner

*Primary Examiner* — Kenneth B Lee, Jr.
(74) *Attorney, Agent, or Firm* — Fenwick & West LLP

(57) ABSTRACT

A display device is proposed, the display device including a display panel having a plurality of pixels; a data driving circuit converting pixel data to a data voltage based on a gamma compensation voltage to supply the same to the plurality of pixels through a plurality of data lines; a gate driving circuit supplying a scan signal through a gate line connected to pixels of each horizontal line of the display panel; a power supply unit supplying a pixel driving voltage to the plurality of pixels through a power line; and a gamma reference voltage adjusting unit adjusting a range of the gamma compensation voltage based on a pixel driving voltage measurement value measured in synchronization with the scan signal at a plurality of positions on the display panel.

10 Claims, 11 Drawing Sheets

DISPLAY DEVICE

CROSS-REFERENCE TO RELATED APPLICATIONS

This application claims the benefit of Korean Patent Application No. 10-2019-0096758 filed on Aug. 8, 2019, the entire contents of which is incorporated herein by reference for all purposes as if fully set forth herein.

BACKGROUND

Field of Technology

The present disclosure relates generally to a display device and, more particularly, to a display device that reflects a drop in a driving voltage in synchronization with a scan signal to compensate for a gamma voltage.

Discussion of the Related Art

A flat panel display device includes a liquid crystal display device (LCD), an electroluminescence display, a field emission display (FED), a quantum dot display device (QD), and the like. The electroluminescent display device is divided into an inorganic light emitting display device and an organic light emitting display device according to the material of the light emitting layer. The pixels of the organic light emitting display device include an organic light emitting diode (OLED), which is a light emitting element that emits light by itself, to display an image by emission of the OLED.

The driving circuit of the flat panel display device includes a data driving circuit that converts digital data corresponding to an input image into a data voltage for driving a pixel to supply the same to data lines, and a gate driving circuit that outputs scan signals (or gate signals) that is synchronized with the data voltage to gate lines. The data driving circuit converts digital data into a data voltage using a digital to analog converter (DAC). The DAC converts the digital data into a gamma voltage to output the data voltage.

The pixels are supplied with a data voltage and a scan gate signal, and are also supplied with a pixel driving power for driving the pixels. For example, pixel driving power such as a high potential pixel driving voltage Vdd and a low potential power voltage Vss are supplied in common to pixels of an organic light emitting display device through a power line so that electric current may flow through an OLED, which is a light emitting element.

However, since a voltage drop amount of the driving voltage in the power line varies depending on the position of the pixel on the display panel, the pixels may actually be supplied with different pixel driving voltages from each other. Accordingly, even when the data voltage of the same size is supplied to the pixel, the luminance of light emitted by the OLED varies according to the position of the pixel, so that the input image, which should be reproduced with the same luminance, may be differently displayed according to the position of the pixel.

In addition, the voltage drop amount of the pixel driving voltage in the power line may also vary depending on a pattern of the input image. When the input image is composed of a dark screen, the voltage drop is not great, so a difference in pixel driving voltage between top and bottom of the display panel is not large. However, when the input image is composed of a bright screen, the farther the transmission path is, the larger the voltage drop is, whereby a difference in driving voltages between top and bottom of the display panel is larger.

SUMMARY

The embodiments disclosed herein take this situation into consideration, and an objective of this disclosure is to provide a display device that causes a pixel to emit light in correspondence to input data regardless of a position of the pixel or a pattern of an input image.

Another objective of this disclosure is to provide a display device that compensates for a difference in pixel driving voltage according to a voltage drop.

Another objective of this disclosure is to provide a configuration for detecting a change in a pixel driving voltage at each position in real time.

A display device according to an embodiment includes a display panel having a plurality of pixels; a data driving circuit converting pixel data to a data voltage based on a gamma compensation voltage to supply the same to the plurality of pixels through a plurality of data lines; a gate driving circuit supplying a scan signal through a gate line connected to pixels of each horizontal line of the display panel; a power supply unit supplying a pixel driving voltage to the plurality of pixels through a power line; and a gamma reference voltage adjusting unit adjusting a range of the gamma compensation voltage based on a pixel driving voltage measurement value measured in synchronization with the scan signal at a plurality of positions on the display panel.

The display device according to an embodiment may further include a sensing line transmitting the pixel driving voltage measurement value to the gamma reference voltage adjusting unit; and a sensing switch transistor controlling a connection between the power line and the sensing line according to the scan signal.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention. In the drawings.

DETAILED DESCRIPTION

Figure 1:
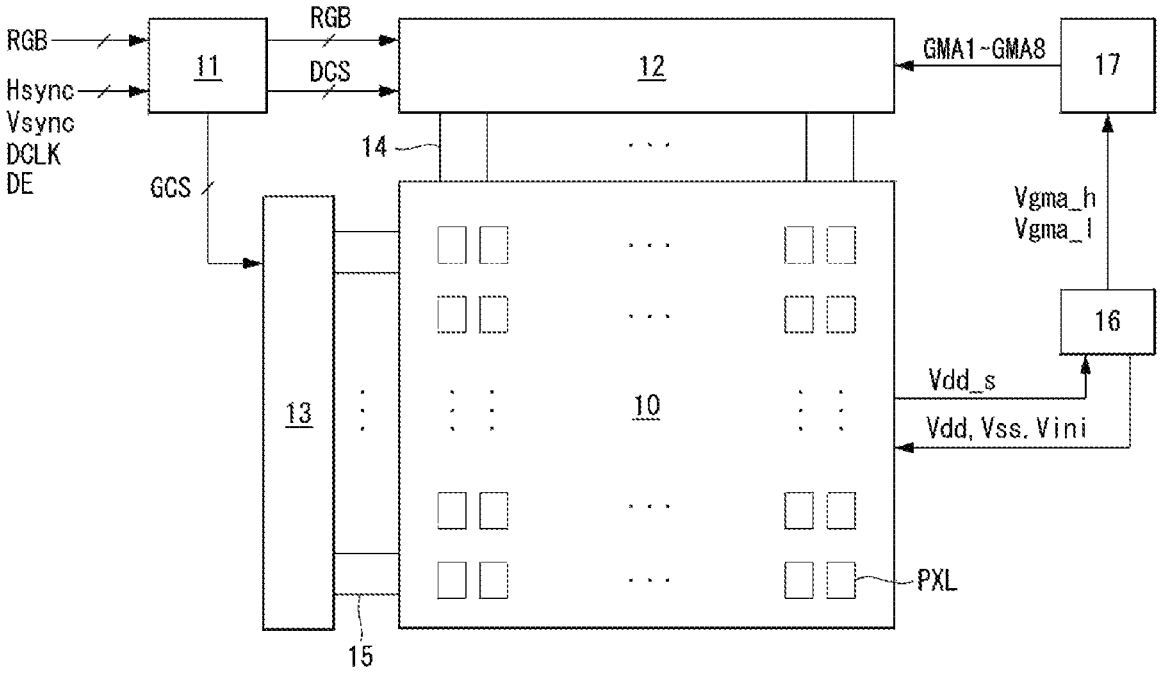
FIG. 1 is a block diagram showing an organic light emitting display device according to one embodiment.

Hereinafter, preferred embodiments will be described in detail with reference to the accompanying drawings. Throughout the specification, the same reference numbers refer to substantially the same components. In the following description, when it is determined that a detailed description of a known function or configuration related to the contents of this specification may unnecessarily obscure or interfere with the understanding of contents, the detailed description will be omitted.

In a display device, a pixel circuit and a gate driving circuit may include one or more of an N-channel transistor (NMOS) and a P-channel transistor (PMOS). A transistor is a three-electrode element, including a gate, a source, and a drain. The source is an electrode through which carriers are supplied to the transistor. In the transistor, the carriers begin to flow from the source. The drain is an electrode through which carriers move out of the transistor. In the transistor, the carriers flow from source to drain. In the case of an N-channel transistor, since the carrier is an electron, the source voltage is lower than the drain voltage so that the electron may flow from source to drain. In the N-channel transistor, currents flow from drain to source. In the case of a P-channel transistor, since the carrier is a hole, the source voltage is higher than the drain voltage so that the hole may flow from source to drain. In the P-channel transistor, since the holes flow from source to drain, electric currents flow from source to drain. It should be noted that the source and drain of the transistor are not fixed. For example, the source and drain may be changed according to the applied voltage. Therefore, the invention is not limited due to the source and drain of the transistor. In the following description, the source and drain of the transistor will be referred to as a first electrode and a second electrode, respectively.

The scan signal (or gate signal) applied to the pixels swings between a gate-on voltage and a gate-off voltage. The gate-on voltage is set to a voltage higher than the transistor's threshold voltage, and the gate-off voltage is set to a voltage lower than the transistor's threshold voltage. The transistor is turned on in response to the gate-on voltage, while the transistor is turned off in response to the gate-off voltage. In the case of an N-channel transistor, the gate-on voltage may be a gate high voltage VGH, and the gate-off voltage may be a gate low voltage VGL. In the case of a P-channel transistor, the gate-on voltage may be a gate low voltage VGL, and the gate-off voltage may be a gate high voltage VGH.

Each pixel of the organic light emitting display device includes an OLED, which is a light emitting element, and a driving element that drives the OLED by supplying an electric current to the OLED according to a voltage Vgs between the gate and source. The OLED includes an anode electrode, a cathode electrode, and an organic compound layer formed between these electrodes. The organic compound layer includes a hole injection layer (HIL), a hole transport layer (HTL), an emission layer (EML), an electron transport layer (ETL), an electron injection layer (EIL), and the like, but not limited thereto. When electric current flows through the OLED, holes passing through the hole transport layer (HTL) and electrons passing through the electron transport layer (ETL) move to the emission layer (EML) to form excitons, whereby the emission layer (EML) may emit visible light.

The driving element may be implemented with a transistor such as a metal oxide semiconductor field effect transistor (MOSFET). Although the driving element should have uniform electrical characteristics between pixels, the electrical characteristics may have a variation between pixels due to a variation in process parameters and a variation in device characteristics and may vary over driving time of the display. An internal compensation method and/or an external compensation method may be applied to the organic light emitting display device to compensate for the variation in the electrical characteristics of the driving element.

The internal compensation method is performed in such a manner as to compensate for a pixel data voltage in the pixel by performing, in real time, sampling for the electrical characteristic of each of the pixels (sub-pixels). The electrical characteristic of the pixel includes a threshold voltage or mobility of the driving element.

The external compensation method is performed in such a manner as to compensate for a change or variation in an electrical characteristic in each of the pixels, by sensing, in real time, electric current or voltage of a pixel that changes according to an electrical characteristic of the pixel, and modulating the pixel data (digital data) of an input image in an external circuit on the basis of the electrical characteristics sensed for each pixel.

The contents disclosed in this specification may be applied to an organic light emitting display device to which the internal compensation method and/or the external compensation method are applied. In the following embodiment, a pixel circuit to which the internal compensation method is applied is illustrated, but is not limited thereto. The external compensation method can reduce the number of transistors and pixel power supplies, which is required in the pixel circuit, compared to the internal compensation method.

FIG. 1 is a block diagram showing an organic light emitting display device. The display device of FIG. 1 may include a display panel 10, a timing controller 11, a data driving circuit 12, a gate driving circuit 13, a power supply unit 16, and a gamma reference voltage generator 17.

Figure 6:
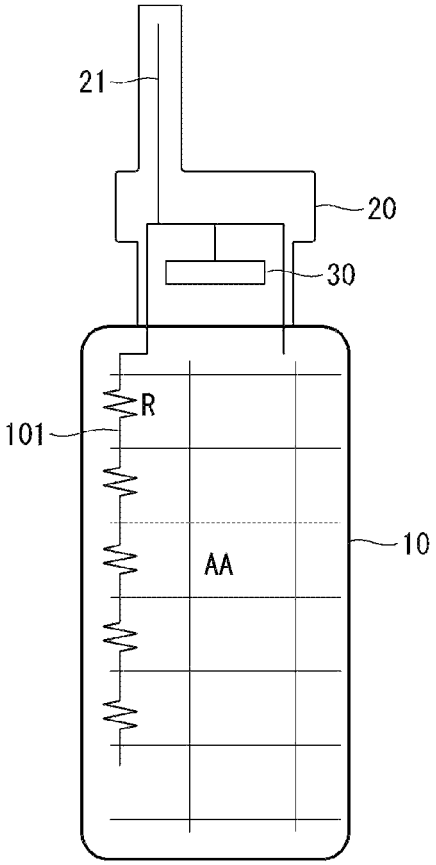
FIG. 6 is a view showing a path of a power line from a host system to a display panel for a mobile terminal according to one embodiment.

FIG. 6 is an implementation view showing a display device for a mobile terminal, in which the display device is configured to include a display panel 10, a flexible printed circuit (FPC) 20, and a drive IC (integrated circuit) 30, and the drive IC 30 may be mounted on the FPC 20.

The timing controller 11, the data driving circuit 12, the gate driving circuit 13, the power supply unit 16, and the gamma reference voltage generator 17 of FIG. 1 are entirely or partially integrated into the drive IC 30 of FIG. 6.

A plurality of data lines 14 arranged in a column direction (or a vertical direction) and a plurality of gate lines 15 arranged in a row direction (or a horizontal direction) intersect with each other in a screen AA of the display panel 10 on which the input image is displayed, and pixels PXL are arranged in a matrix form for each intersection area to form a pixel array. The gate line 15 may include a first gate line 15_1 that supplies a scan signal for applying a data voltage supplied to the data line 14 to a pixel, and a second gate line 15_2 that supplies a light emission signal for enabling a pixel in which a data voltage is written to emit light.

The display panel 10 includes a first power supply line 101 that supplies a pixel driving voltage (or high potential power supply voltage) Vdd to the pixels PXL, a second power line 102 that supplies a low potential power supply voltage Vss to the pixels PXL, an initialization voltage line 103 that supplies an initialization voltage Vini for initializing the pixel circuit, and the like. The first/second power lines 101 and 102 and the initialization voltage line 103 are connected to the power supply unit 16. The second power line 102 may also be formed in the form of a transparent electrode covering the pixels PXL.

Touch sensors may be disposed on the pixel array of the display panel 10. The touch input may be detected using separate touch sensors or may be detected through the pixels. The touch sensors may be placed on a screen AA of the display panel PXL in an on-cell type or an add-on type, or implemented with in-cell type touch sensors embedded in the pixel array.

In the pixel array, pixels PXL disposed on the same horizontal line are connected to any one of the data lines 14 and any one of the gate lines 15 (or any one of the first gate lines 15_1 and any one of the second gate lines 15_2) to form a pixel line. The pixel PXL is electrically connected to the data line 14 in response to the scan signal and the light emission signal applied through the gate line 15 to receive the data voltage and make the OLED to emit light with electric current corresponding to the data voltage. The pixels PXL disposed in the same pixel line operate simultaneously according to the scan signal and the light emission signal applied from the same gate line 15.

One-pixel unit may be composed of three subpixels including a red subpixel, a green subpixel, and a blue subpixel, or four subpixels including a red subpixel, a green subpixel, a blue subpixel, and a white subpixel, but is not limited to thereto. Each sub-pixel may be implemented with a pixel circuit including an internal compensation circuit. Hereinafter, a pixel means a subpixel.

Figure 4:
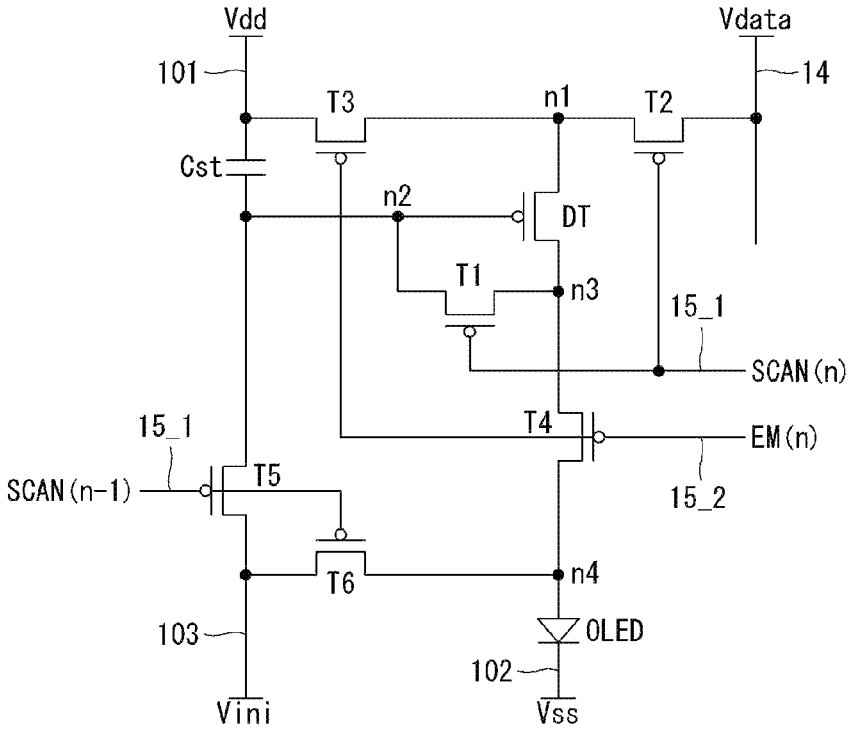
FIG. 4 is a view showing an example of a pixel circuit according to one embodiment.

The pixel PXL receives a pixel driving voltage Vdd, an initialization voltage Vini, and a low potential power supply voltage Vss from the power supply unit 16, and may include a driving transistor, an OLED, and an internal compensation circuit. The internal compensation circuit may be composed of a plurality of switch transistors and one or more capacitors as shown in FIG. 4 described below.

The timing controller 11 supplies image data RGB transmitted from an external host system (not shown) to the data driving circuit 12. The timing controller 11 receives timing signals such as a vertical synchronization signal Vsync, a horizontal synchronization signal Hsync, a data enable signal DE, and a dot clock DCLK from the host system, and generates control signals for controlling operation timings of the data driving circuit 12 and the gate driving circuit 13. The control signals include a gate timing control signal GCS for controlling the operation timing of the gate driving circuit 13 and a data timing control signal DCS for controlling the operation timing of the data driving circuit 12.

The data driving circuit 12 converts digital video data RGB input from the timing controller 11 into an analog data voltage on the basis of the data control signal DCS, and supplies the data voltage to the pixels PXL through an output channel and data lines 14. The data voltage may have a value corresponding to a gradation of a pixel. The data driving circuit 12 may be composed of a plurality of drivers IC When the gate driving circuit 13 generates a scan signal and a light emission signal on the basis of the gate control signal GCS, the gate driving circuit 13 generates the scan signal and the light emission signal in a row sequential manner during an active period and sequentially provides the same to the gate line 15 connected to each pixel line. The scan signal and the light emission signal from the gate line 15 are synchronized with the supply of the data voltage from the data line 14. The scan signal and the emission signal swing between a gate-on voltage VGL and a gate-off voltage VGH. The gate-on voltage VGL and the gate-off voltage VGH may be set to VGH=8V and VGL=−7V, but are not limited thereto.

The gate driving circuit 13 may be configured with multiple gate drive integrated circuits that each includes a shift register, a level shifter for converting the output signal of the shift register to a swing width suitable for driving a TFT of the pixel, an output buffer, etc. Alternatively, the gate driving circuit 13 may be directly formed on the lower substrate of the display panel 10 by a gate drive IC in panel (GIP) method. In the case of the GIP method, the level shifter is mounted on a printed circuit board (PCB), and the shift register may be formed on the lower substrate of the display panel 10.

The power supply unit 16 adjusts a DC input voltage provided from the host system using a DC-DC converter, to generate a gate-on voltage VGL and a gate-off voltage VGH required for operating the data driving circuit 12 and the gate driving circuit 13, and to generate a pixel driving voltage Vdd, a initialization voltage Vini, and a low potential power supply voltage Vss required for driving the pixel array.

The power supply unit 16 receives the pixel driving voltage Vdd_s actually supplied to pixels PXL at each position of the display panel 10 in real time, and generates a low potential/high potential gamma input voltage Vgma_l/Vgma_h on the basis of the pixel driving voltage Vdd_s and provides the same to the gamma reference voltage generator 17.

The gamma reference voltage generator 17 generates gamma reference voltages GMA1 to GMA8 in a range determined by the low potential/high potential gamma input voltage Vgma_l/Vgma_h, and thus the low potential/high potential gamma input voltage Vgma_l/Vgma_h may determine a generation range of the gamma reference voltage, that is, upper and lower limits of the gamma reference voltage.

The host system may be an application processor (AP) in a mobile device, a wearable device, and a virtual/augmented reality device. Alternatively, the host system may be a main board such as a television system, a set top box, a navigation system, a personal computer, a home theater system, and the like, but is not limited thereto.

Figure 2:
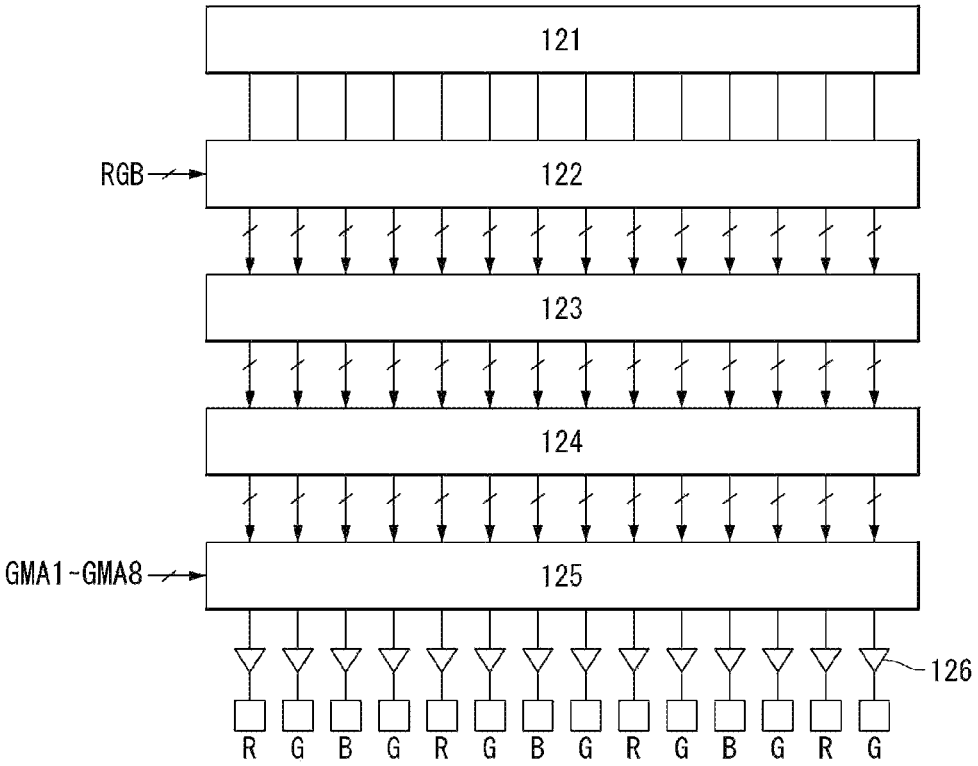
FIG. 2 is a view showing a specific configuration of the data driver according to one embodiment.

FIG. 2 is a view showing a specific configuration of a data driving circuit.

Referring to FIG. 2, the data driving circuit 12 includes a shift register 121, a first latch 122, a second latch 123, a level shifter 124, a digital-to-analog converter (DAC) 125, and a buffer 126.

The shift register 121 shifts clocks input from the timing controller 11 and then sequentially outputs clocks for sampling. The first latch 122 samples and latches the pixel data RGB of the input image based on the sampling clock sequentially input from the shift register 121, and simultaneously outputs the sampled pixel data RGB. The second latch 123 simultaneously outputs the pixel data RGB input from the first latch 122.

The level shifter 124 shifts the voltage of the pixel data RGB input from the second latch 123 into a range of an input voltage of the DAC 125. The DAC 125 converts the pixel data RGB from the level shifter 124 into a data voltage on the basis of the gamma compensation voltage and outputs the same. The data voltage output from the DAC 125 is supplied to the data line 14 through the buffer 126.

Figure 3:
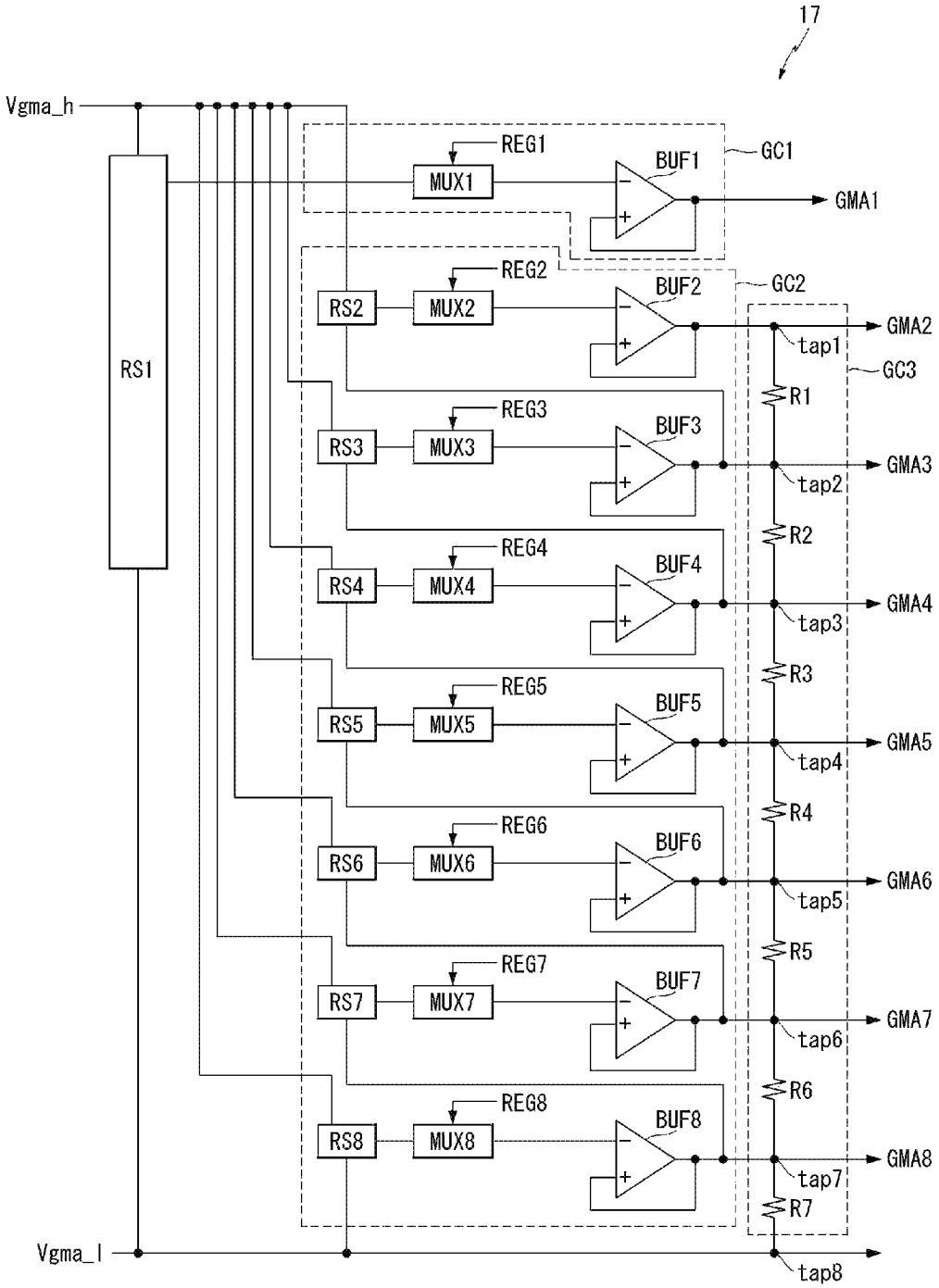
FIG. 3 is a view showing a gamma reference voltage generator according to one embodiment.

FIG. 3 is a view showing a gamma reference voltage generator.

In FIG. 3, it is shown that a gamma reference voltage generator 17 outputs eight gamma reference voltages GMA1 to GMA8, but the number of gamma reference voltages output by the gamma reference voltage generator is not limited thereto.

Referring to FIG. 3, the gamma reference voltage generator 17 includes a first voltage divider RS1 and first to third voltage divider circuits GC1, GC2, and GC3, and generates the highest gamma reference voltage (hereinafter, first gamma reference voltages GMA1) and second to eighth gamma reference voltages GMA2 to GMA8.

The first voltage divider circuit GC1 generates a first gamma reference voltage GMA1 on the basis of a voltage obtained from division of the first voltage divider RS1. To this end, the first voltage divider circuit GC1 includes a first multiplexer MUX1 and a first buffer BUF1.

The first voltage divider RS1 may be formed of a number of resistors connected in series with each other between an input terminal of the high potential gamma input voltage Vgma_h and an input terminal of the low potential input reference voltage Vgma_l. The first multiplexer MUX1 receives the voltage obtained from division of the first voltage divider RS1 and outputs a voltage selected according to the highest gamma register value REG1. The first buffer BUF1 prevents electric current from flowing in reverse, and allows the first gamma reference voltage GMA1 to be smoothly transmitted.

The second voltage divider circuit GC2 divides the high potential gamma input voltage Vgma_h to generate second to eighth gamma reference voltages GMA2 to GMA8. The second voltage divider circuit GC2 includes second to eighth voltage dividers RS2 to RS8, second to eighth multiplexers MUX2 to MUX8, and second to eighth buffers BUF2 to BUF8.

Second to seventh voltage dividers RS2 to RS7 receive the high-potential gamma input voltage Vgma_h and the rear-end gamma input voltage, respectively, and divide the high-potential gamma input voltage Vgma_h. The eighth voltage divider RS8 receives the high potential gamma input voltage Vgma_h and the low potential gamma input voltage Vgma_l and divides the high potential gamma input voltage Vgma_h. Each of the second to eighth voltage dividers RS2 to RS8 may be made of a variable resistor.

Each of the second to eighth multiplexers MUX2 to MUX8 selects, as a gamma reference voltage, any one of the voltages obtained from dividing by the second to eighth voltage dividers RS2 to RS8 according to the preset gamma register values REG2 to REG8. The second to seventh voltage dividers RS2 to RS7 receive a high potential gamma input voltage Vgma_h and a rear-end gamma reference voltage to divide the high potential gamma input voltage Vgma_h, and the eighth voltage divider RS8 receives the high potential gamma input voltage Vgma_h and a low potential gamma input voltage Vgma_l and divides the high potential gamma input voltage Vgma_h. The second to eighth buffers BUF2 to BUF8 prevent electric current from flowing in reverse, and allow the second to eighth gamma reference voltages GMA2 to GMA8 to be smoothly output.

Specifically, the second voltage divider RS2 receives the high potential gamma input voltage Vgma_h and a third gamma reference voltage GMA3 and divides the high potential gamma input voltage Vgma_h. The second multiplexer MUX2 selects any one of voltages obtained from dividing by the second voltage divider RS2 according to the second gamma register value REG2, and outputs the selected voltage through the second buffer BUF2 as the second gamma reference voltage GMA2.

The third voltage divider RS3 receives the high potential gamma input voltage Vgma_h and a fourth gamma reference voltage GMA4 and divides the high potential gamma input voltage Vgma_h. The third multiplexer MUX3 selects any one of voltages obtained from dividing by the third voltage divider RS3 according to the third gamma register value REG3, and outputs the selected voltage through the third buffer BUF3 as the third gamma reference voltage GMA3.

The fourth voltage divider RS4 receives the high potential gamma input voltage Vgma_h and a fifth gamma reference voltage GMA5 and divides the high potential gamma input voltage Vgma_h. The fourth multiplexer MUX4 selects any one of voltages obtained from dividing by the fourth voltage divider RS4 according to the fourth gamma register value REG4, and outputs the selected voltage through the fourth buffer BUF4 as the fourth gamma reference voltage GMA4.

The fifth voltage divider RS5 receives the high potential gamma input voltage Vgma_h and the sixth gamma reference voltage GMA6 and divides the high potential gamma input voltage Vgma_h. The fifth multiplexer MUX5 selects any one of voltages obtained from dividing by the fifth voltage divider RS5 according to the fifth gamma register value REG5, and outputs the selected voltage through the fifth buffer BUF5 as the fifth gamma reference voltage GMA5.

The sixth voltage divider RS6 receives the high potential gamma input voltage Vgma_h and a seventh gamma reference voltage GMA7 and divides the high potential gamma input voltage Vgma_h. The sixth multiplexer MUX6 selects one of the voltages obtained from dividing by the sixth voltage divider RS6 according to the sixth gamma register value REG6, and outputs the selected voltage through the sixth buffer BUF6 as the sixth gamma reference voltage GMA6.

The seventh voltage divider RS7 receives the high potential gamma input voltage Vgma_h and an eighth gamma reference voltage GMA8 and divides the high potential gamma input voltage Vgma_h. The seventh multiplexer MUX7 selects one of voltages obtained from dividing by the seventh voltage divider RS7 according to the seventh gamma register value REG7, and outputs the selected voltage through the seventh buffer BUF7 as a seventh gamma reference voltage GMA7.

The eighth voltage divider RS8 receives the high potential gamma input voltage Vgma_h and a low potential gamma input voltage Vgma_l and divides the high potential gamma input voltage Vgma_h. The eighth multiplexer MUX8 selects any one of voltages obtained from dividing by the eighth voltage divider RS8 according to the eighth gamma register value REG8, and outputs the selected voltage through the eighth buffer BUF8 as an eighth gamma reference voltage GMA8.

The third voltage divider circuit GC3 includes the first to seventh resistors R1 to R7, and the first to seventh resistors are disposed between taps tap1 to tap8 that output the second to eighth gamma reference voltages GMA2 to GMA8. For example, the first resistor R1 is disposed between the first tap tap1 and the second tap tap2, and the seventh resistor R7 is disposed between the seventh tap tap7 and the eighth tap tap8. The third voltage divider circuit GC3 allows a voltage level of each of the second to eighth gamma reference voltages GMA2 to GMA8 output through each of the taps tap1 to tap7 to be stably maintained.

The data driving circuit 12 includes an DAC 125 that converts pixel data RGB of an input image into an analog data voltage Vdata, as shown in FIG. 2. The DAC 125 needs 256 gamma compensation voltages, to convert, for example, 8-bit pixel data RGB into 0 to 255 different analog data voltages Vdata. To this end, a gamma compensation voltage generator, which converts the predetermined number of gamma reference voltages output by the gamma reference voltage generator 17 into, for example, 256 gamma compensation voltages, may be added between the gamma reference voltage generator 17 and the DAC 125.

When the timing controller 11, the data driving circuit 12, the gate driving circuit 13, the power supply unit 16, and the gamma reference voltage generator 17 are integrated into one drive IC, the gamma reference voltage generator 17 and the gamma compensation voltage generator in front of the DAC 125 may be integrated into one block to generate a gamma compensation voltage.

The gamma compensation voltage for generating the data voltage may be implemented as a positive gamma or a negative gamma depending on the pixel circuit structure. For example, when a driving transistor driving a light emitting element of a pixel, for example, an OLED is implemented with a P-channel MOSFET and a data voltage is applied to a gate electrode of the driving transistor, the gamma compensation voltage is generated as the negative gamma, so that the higher the gray level of the pixel data RGB, the lower the gamma compensation voltage. When a driving transistor driving a light emitting element of pixels is implemented with an N-channel MOSFET, and a data voltage is applied to the gate of the driving transistor, the gamma compensation voltage is generated as the positive gamma, so that the higher the gray level of the pixel data RGB, the higher the gamma compensation voltage.

Figure 5:
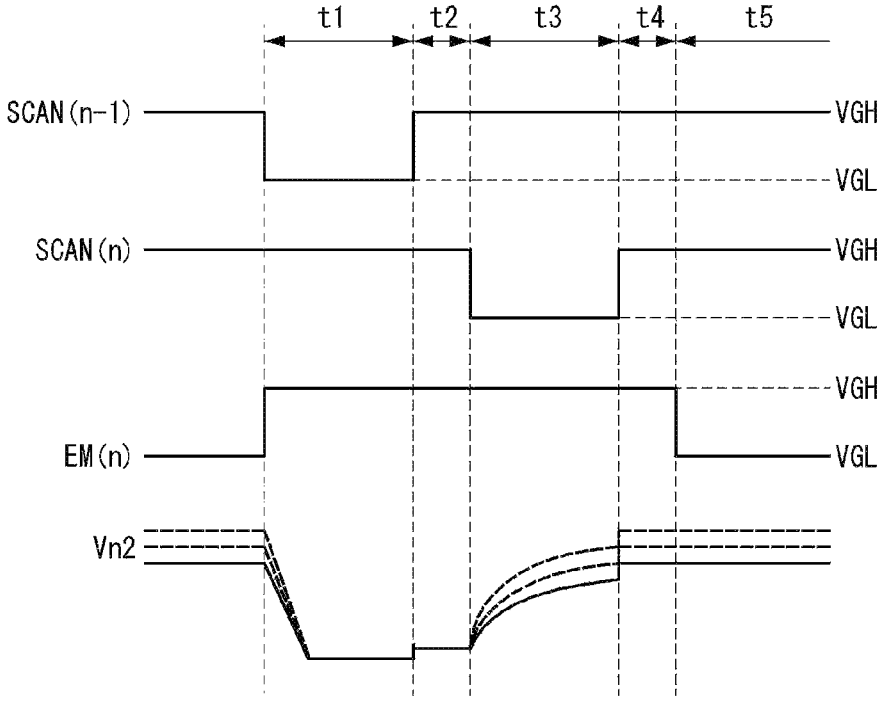
FIG. 5 is a view showing driving-related signals in the pixel circuit of FIG. 4 according to one embodiment.

FIG. 4 is a view showing an example of a pixel circuit, and FIG. 5 is a view showing driving-related signals driving in the pixel circuit of FIG. 4. The pixel circuit of FIG. 4 is only an example, and the pixel circuit to which the embodiment of this specification is applied is not limited to FIG. 4.

The pixel circuit of FIG. 4 includes an internal compensation circuit, a light emitting element, and a driving element (DT) that supplies electric current to the light emitting element. The internal compensation circuit may be composed a plurality of switch transistors T1 to T6, and a storage capacitor Cst. The internal compensation circuit samples a threshold voltage Vth of a driving element DT to compensate for a gate voltage of the driving element DT by the threshold voltage Vth of the driving element DT. Each of the driving element DT and the switch transistors T1 to T6 may be implemented with a P-channel transistor, but is not limited thereto.

The pixel circuit of FIG. 4 is for a pixel arranged on the n-th horizontal line (or pixel line). The operation period of the pixel circuit in FIG. 4 is largely divided into initialization periods t1 and t2, a sampling period t3, a data writing period t4, and a light emission period t5.

In the initialization period t1, a (n−1)-th scan signal SCAN(n−1) for controlling the supply of the data voltage to pixels of a (n−1)-th horizontal line is applied as a gate-on voltage VGL, so that fifth and sixth switch transistors T5 and T6 are turned on and thus the pixel circuit is initialized. Before a n-th scan signal SCAN(n) for controlling the supply of the data voltage to the current horizontal line is applied as a gate-on voltage VGL after the initialization period t1, a hold period t2 in which the (n−1)-th scan signal SCAN(n−1) is changed from the gate-on voltage VGL to a gate-off voltage VGH is arranged, but the hold period t2 corresponding to the second period may be omitted.

In the sampling period t3, the n-th scan signal SCAN(n) for controlling the supply of the data voltage to the current horizontal line is applied as a gate-on voltage VGL, so that the first and second switch transistors T1 and T2 are turned on, and the threshold voltage of the driving element (or driving transistor) DT is sampled and stored in the storage capacitor Cst. During the sampling period t3, a voltage of the gate electrode of the driving transistor DT rises by electric current flowing through the first and second switch transistors T1 and T2.

In the data writing period t4, the n-th scan signal SCAN (n) is applied as a gate-off voltage VGH, so that the first and second switch transistors T1 and T2 are turned off and the remaining switch transistors T3 to T6 are all turned off, and a voltage of the gate electrode of the driving transistor DT rises by electric current flowing through the driving transistor DT.

In the light emission period t5, the n-th emission signal EM(n) is applied as a gate-on voltage VGL, so that the third and fourth switch transistors T3 and T4 are turned on to make the light emitting element to emit light.

In order to accurately express low-gray-level luminance, the emission signal EM(n) swings between the gate-on voltage VGL and the gate-off voltage VGH at a predetermined duty ratio during the light emission period t5, so that the third and fourth switch transistors T3 and T4 may repeat the on/off operation.

An anode electrode of the light emitting element is connected to a fourth node n4 between the fourth and sixth switch transistors T4 and T6. The fourth node n4 is connected to an anode electrode of the light emitting element, a second electrode of the fourth switch transistor T4, and a second electrode of the sixth switch transistor T6. A cathode electrode of the light emitting element is connected to the second power line 102 to which the low potential power voltage Vss is applied. The light emitting element emits light with electric current flowing according to a voltage Vgs between gate and source of the driving element DT. The electric current flowing in the light emitting element is switched by the third and fourth switch transistors T3 and T4.

The storage capacitor Cst is connected between the first power line 101 and the second node n2. The data voltage Vdata compensated by a threshold voltage Vth of the driving element DT is charged in the storage capacitor Cst. Since the data voltage Vdata in each of the pixels is compensated by the threshold voltage Vth of the driving element DT, a variation in a characteristic of the driving element DT in the pixels may be compensated.

The first switch transistor T1 is turned on in response to the gate-on voltage VGL of the n-th scan signal SCAN(n) to connect a second node n2 with a third node n3. The second node n2 is connected to a gate electrode of the driving element DT, a first electrode of the storage capacitor Cst, and a first electrode of the first switch transistor T1. The third node n3 is connected to a second electrode of the driving element DT, a second electrode of the first switch transistor T1, and a first electrode of the fourth switch transistor T4. The gate electrode of the first switch transistor T1 is connected to a first gate line 15_1 to receive the n-th scan signal SCAN(n). The first electrode of the first switch transistor T1 is connected to the second node n2, and the second electrode of the first switch transistor T1 is connected to the third node n3.

The second switch transistor T2 is turned on in response to the gate-on voltage VGL of the n-th scan signal SCAN(n) to supply the data voltage Vdata to the first node n1. The gate electrode of the second switch transistor T2 is connected to the first gate line 15_1 to receive the n-th scan signal SCAN(n). The first electrode of the second switch transistor T2 is connected to a data line 14 to which the data voltage Vdata is applied. The second electrode of the second switch transistor T2 is connected to the first node n1. The first node n1 is connected to the second electrode of the second switch transistor T2, a second electrode of the third switch transistor T3, and a first electrode of the driving element DT.

The third switch transistor T3 is turned on in response to the gate-on voltage VGL of the emission signal EM(n) to connect the first power line 101 to the first node n1. A gate electrode of the third switch transistor T3 is connected to the second gate line 15_2 to receive the emission signal EM(n). A first electrode of the third switch transistor T3 is connected to the first power line 101. A second electrode of the third switch transistor T3 is connected to the first node n1.

The fourth switch transistor T4 is turned on in response to the gate-on voltage VGL of the emission signal EM(n) to connect the third node n3 to the anode electrode of the light emitting element. A gate electrode of the fourth switch transistor T4 is connected to the second gate line 15_2 to receive the emission signal EM(n). A first electrode of the fourth switch transistor T4 is connected to the third node n3, and a second electrode of the fourth switch transistor T4 is connected to the fourth node n4.

The emission signal EM(n) performs on/off control for the third and fourth switch transistors T3 and T4 to switch the current flow of the light emitting element, thereby controlling lighting-on and lighting-off of the light emitting element.

The fifth switch transistor T5 is turned on in response to the gate-on voltage VGL of the (n−1)-th scan signal SCAN (n−1) to connect the second node n2 to the initialization voltage line 103. The gate electrode of the fifth switch transistor T5 is connected to the first gate line 15_1 that supplies a scan signal to control the supply of the data voltage to pixels of the (n−1)-th horizontal line to receive the (n−1)-th scan signal SCAN(n−1). A first electrode of the fifth switch transistor T5 is connected to the second node n2, and a second electrode of the fifth switch transistor T5 is connected to the initialization voltage line 103.

The sixth switch transistor T6 is turned on in response to the gate-on voltage VGL of the (n−1)-th scan signal SCAN (n−1) to connect the initialization voltage line 103 to the fourth node n4. The gate electrode of the sixth switch transistor T6 is connected to the first gate line 15_1 for the (n−1)-th horizontal line and receives the (n−1)-th scan signal SCAN(n−1). A first electrode of the sixth switch transistor T6 is connected to the initialization voltage line 103, and a second electrode of the sixth switch transistor T6 is connected to the fourth node n4.

The driving element DT controls the current flowing through the light emitting element according to a voltage Vgs between gate and source to drive the light emitting element. The driving element DT includes a gate electrode connected to the second node n2, a first electrode connected to the first node n1, and a second electrode connected to the third node n3.

During the initialization period t1, the (n−1)-th scan signal SCAN(n−1) is input as a gate-on voltage VGL. The n-th scan signal SCAN(n) and the emission signal EM(n) maintain a gate-off voltage VGH during the initialization period t1. Accordingly, during the initialization period t1, the fifth and sixth switch transistors T5 and T6 are turned on to allow the second and fourth nodes n2 and n4 to be initialized with the initialization voltage Vini. A hold period t2 may be set between the initialization period t1 and the sampling period t3. In the hold period t2, the (n−1)-th scan signal SCAN(n−1) is changed from the gate-on voltage VGL to the gate-off voltage VGH, and each of the n-th scan signal SCAN(n) and the emission signal EM(n) maintains its previous state.

During the sampling period t3, the n-th scan signal SCAN(n) is input as a gate-on voltage VGL. The pulse of the n-th scan signal SCAN(n) is synchronized with the data voltage Vdata to be supplied to the n-th horizontal line. The (n−1)-th scan signal SCAN(n−1) and the emission signal EM(n) maintain the gate-off voltage VGH during the sampling period t3. Therefore, the first and second switch transistors T1 and T2 are turned on during the sampling period t3.

During the sampling period t3, a voltage of the gate terminal of the driving element DT, that is, the second node n2 is increased by electric current flowing through the first and second switch transistors T1 and T2. When the driving element DT is turned off, the voltage Vn2 of the second node n2 is (Vdata−|Vth|). Herein, the voltage of the first node n1 is Vdata. The voltage Vgs between gate and source of the driving element DT in the sampling period t3 is |Vgs|=Vdata−(Vdata−|Vth|)=|Vth|.

During the data writing period t4, the n-th scan signal SCAN(n) is inverted to the gate-off voltage VGH. The (n−1)-th scan signal SCAN(n−1) and the emission signal EM(n) maintain the gate-off voltage VGH during the data writing period t4. Therefore, during the data writing period t4, all the switch transistors T1 to T6 maintain an off state.

During the light emission period t5, the emission signal EM(n) continuously maintains the gate-on voltage VGL or is turned on/off at a predetermined duty ratio to swing between the gate-on voltage VGL and the gate-off voltage VGH. During the light emission period t5, the (n−1)-th and n-th scan signals SCAN(n−1) and SCAN(n) maintain the gate-off voltage VGH. During the light emission period t5, the third and fourth switch transistors T3 and T4 may repeat on/off according to the voltage of the emission signal EM(n). When the emission signal EM(n) has the gate-on voltage VGL, the third and fourth switch transistors T3 and T4 are turned on to allow electric current to flow in the light emitting element. Herein, the voltage Vgs between gate and source of the driving element DT is |Vgs|=Vdd−(Vdata−|Vth|), and the current flowing through the light emitting element is $K(Vdd-Vdata)^2$, wherein K is a proportional constant determined by a charge mobility, a parasitic capacitance, and a channel capacity of the driving element DT.

The luminance of the light emitted by the light emitting element is proportional to electric current flowing through the light emitting element. When a pixel driving voltage Vdd supplied through the first power line 101 changes according to a load or a pattern of an input image, but the input data voltage Vdata remains unchanged, the luminance of the light emitted by the light emitting element varies according to the pixel driving voltage Vdd for the same data voltage Vdata.

FIG. 6 is a view showing a path of a power line from a host system to a display panel for a mobile terminal.

The pixel driving voltage Vdd supplied directly from the host system or the pixel driving voltage Vdd generated by the power supply unit 16 included in the drive IC 30 using an input power received from the host system is supplied to the display panel 10 through a power wiring 21 formed in the FPC 20. The first power line 101 formed in the form of a mesh on the display panel 10 is connected to the power wiring 21 of the FPC 20 to supply the pixel driving voltage Vdd to the pixel PXL.

A voltage drop (IR Drop) in the pixel driving voltage Vdd supplied to the display panel 10 occurs according to the load of the display panel 10, in which an amount of the voltage drop varies according to a load variation of the display panel 10. The load of the display panel 10 is determined by a resistance R and a capacitance C, and may be additionally changed by the luminance of the screen AA (for example, an average picture level (APL)) determined by a pattern of the input image, that is, the input data.

When the APL of the input image is high, electric current consumed by the pixels PXL included in the display panel 10 increases, so the an amount of voltage drop of the pixel driving voltage Vdd increases, and when the APL of the input image is low, electric current consumed by the pixels PXL included in the display panel 10 decreases, whereby the voltage drop amount of the pixel driving voltage Vdd is reduced.

In order to compensate for the voltage drop of the pixel driving voltage Vdd according to the load of the display panel, the pixel driving voltage Vdd is measured at a specific point of the display panel 10, mainly a point at which the pixel driving voltage Vdd is applied, and the data voltage may be varied on the basis of the measured pixel driving voltage Vdd.

In addition, in order to compensate for the voltage drop of the pixel driving voltage Vdd due to the pattern of the input image, as an emission operation for each pixel line proceeds from top to bottom of the display panel 10, an accumulative current value (or APL) is calculated up to the pixel line currently driven, and a gain of increasing the pixel driving voltage Vdd may be adjusted on the basis of the accumulative current value. In order to compensate for the voltage drop of the pixel driving voltage Vdd, these two compensation algorithms may be used together.

Figure 7:
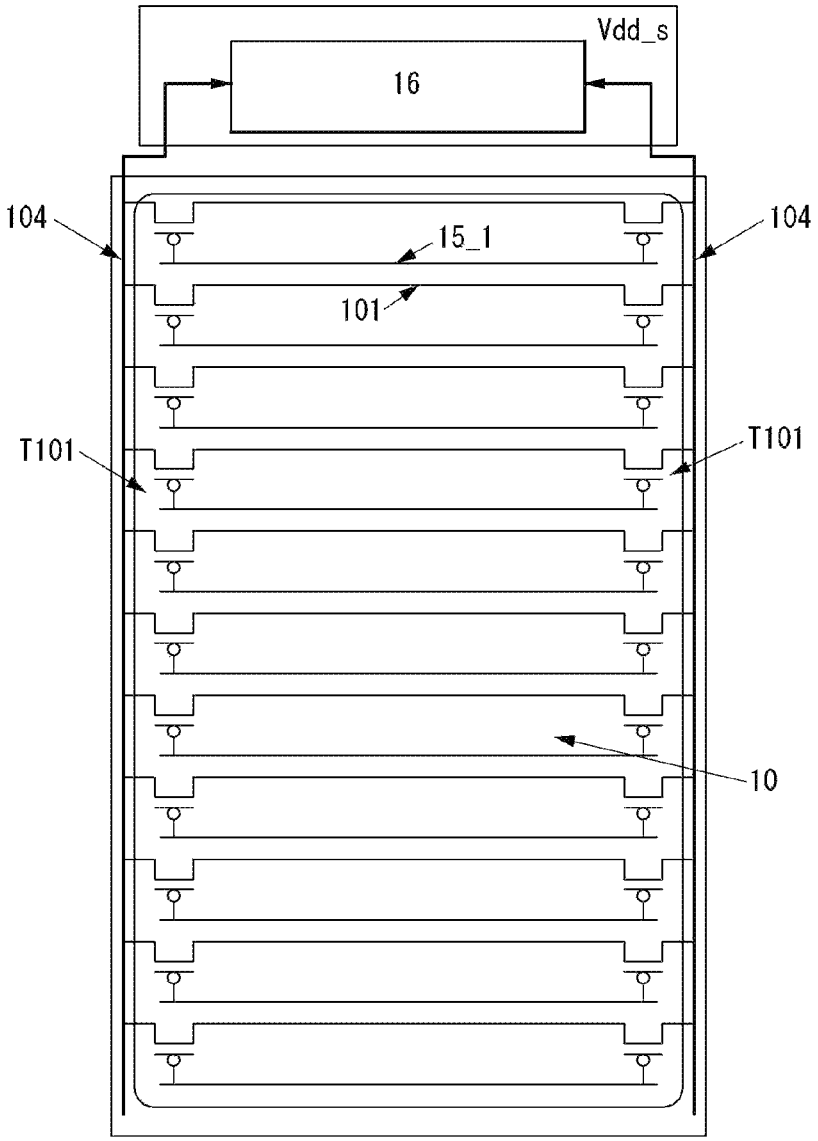
FIG. 7 is a view showing a configuration for feedback of a pixel driving voltage in real time according to one embodiment.
Figure 8:
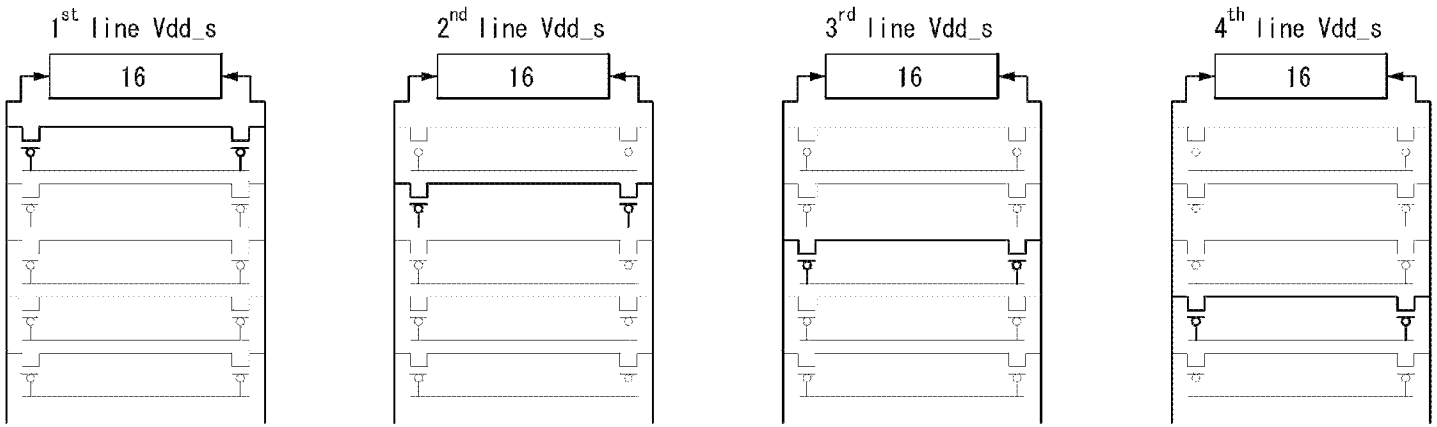
FIG. 8 is a view showing a process of sequentially detecting a pixel driving voltage in synchronization with a scan signal according to one embodiment.

FIG. 7 is a view showing a configuration for feedback of the pixel driving voltage in real time, and FIG. 8 is a view showing a process of sequentially detecting the pixel driving voltage in synchronization with the scan signal.

When measuring the pixel driving voltage Vdd at a fixed position to compensate for the voltage drop of the pixel driving voltage Vdd, there is a problem of not reflecting that the pixel driving voltage Vdd varies depending on the position. To solve this problem, the pixel driving voltage Vdd should be detected in real time at multiple locations.

In FIG. 7, when the pixel driving voltage Vdd is measured in real time at a location (pixel line) to which the scan signal is applied in synchronization with the scan signal, it is possible to compensate for a luminance variation according to the voltage drop of the pixel driving voltage Vdd.

As shown in FIG. 6, the first power line 101 supplying the pixel driving voltage Vdd to the pixel is connected in a mesh form, and a widthwise wiring of the first power line 101 extending in the widthwise direction (or the direction in which the gate line extends) is arranged for each horizontal line (or pixel line) so that the pixel driving voltage Vdd may be supplied to pixels in the corresponding horizontal line. Alternatively, the widthwise wiring of the first power line 101 extending in the widthwise direction may be arranged once for a plurality of horizontal lines.

As shown in FIG. 7, a sensing line 104 is provided in the outer area (or non-display area) of the screen (or display area) AA in the display panel 10, and the sensing line 104 may be connected to the widthwise wiring of the first power line 101 through a sensing switch transistor T101 controlled by using the scan signal applied to the first gate line 15_1. The sensing line 104 is connected to the power supply unit 16 so that a pixel driving voltage Vdd_s actually measured is fed back to the power supply unit 16.

When the sensing switch transistor T101 is turned on by the scan signal of the gate-on voltage, the widthwise wiring of the first power line 101 disposed on the corresponding horizontal line is connected to the sensing line 104, and the actual value Vdd_s of the pixel driving voltage Vdd supplied to pixels of the horizontal line is supplied to the power supply unit 16 via the sensing line 104.

As shown in FIG. 8, when performing a scan operation that supplies a data voltage to pixels of the first horizontal line, that is, when the first scan signal SCAN(1) of the gate-on voltage is supplied to the first gate line 15_1 of the first horizontal line, the sensing switch transistor T101 is turned on by the first scan signal SCAN(1). Accordingly, the first widthwise wiring of the first power line 101 extending in the widthwise direction is connected to the sensing line 104 so that the pixel driving voltage Vdd_s actually supplied to pixels of the first horizontal line is transmitted to the power supply unit 16 via the sensing line 104.

Similarly, when performing a scan operation that supplies a data voltage to pixels of the second horizontal line, that is, when the second scan signal SCAN(2) of the gate-on voltage is supplied to the first gate line 15_1 of the second horizontal line, the sensing switch transistor T101 is turned on by the second scan signal SCAN(2), so that the second widthwise wiring of the first power line 101 is connected to the sensing line 104, and the pixel driving voltage Vdd_s actually supplied to pixels of the second horizontal line is transmitted to the power supply unit 16 via the sensing line 104.

Similarly for each of the third horizontal line and the fourth horizontal line, a pixel driving voltage Vdd_s actually supplied to pixels of the horizontal line is transmitted to the power supply unit 16 through the sensing line 104 by the scan signal driving the pixels of the horizontal line.

The pixel driving voltage measurement value Vdd_s detected and fed back in real time at each location in connection with the scan signal may be used to change a generation range of the gamma compensation voltage used when converting the pixel data to the data voltage. When the gamma compensation voltage is changed, different data voltages are output for the same pixel data. Therefore, when the range of the gamma compensation voltage is changed according to a pixel driving voltage Vdd_s actually supplied to the pixel, the data voltage applied to the pixel may be changed.

When a plurality of sensing switch transistors T101 is provided once, for example, for every k horizontal lines, the power supply unit 16 may sense a pixel driving voltage Vdd_s actually supplied to the pixel once every k scan signals (or every k horizontal periods). When the pixel driving voltage Vdd_s is detected once every k horizontal periods, the gamma compensation voltage may also be changed once every k horizontal periods.

Figure 9:
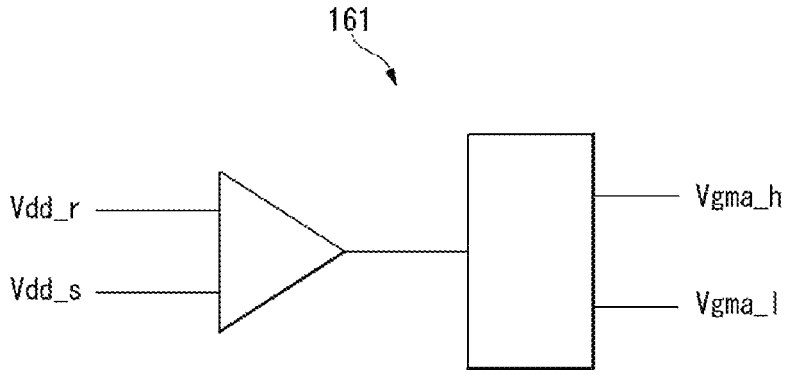
FIG. 9 is a view showing a configuration for generating a low potential/high potential gamma input voltage supplied to a gamma reference voltage generator using an actual pixel driving voltage that is fed back according to one embodiment.
Figure 10:
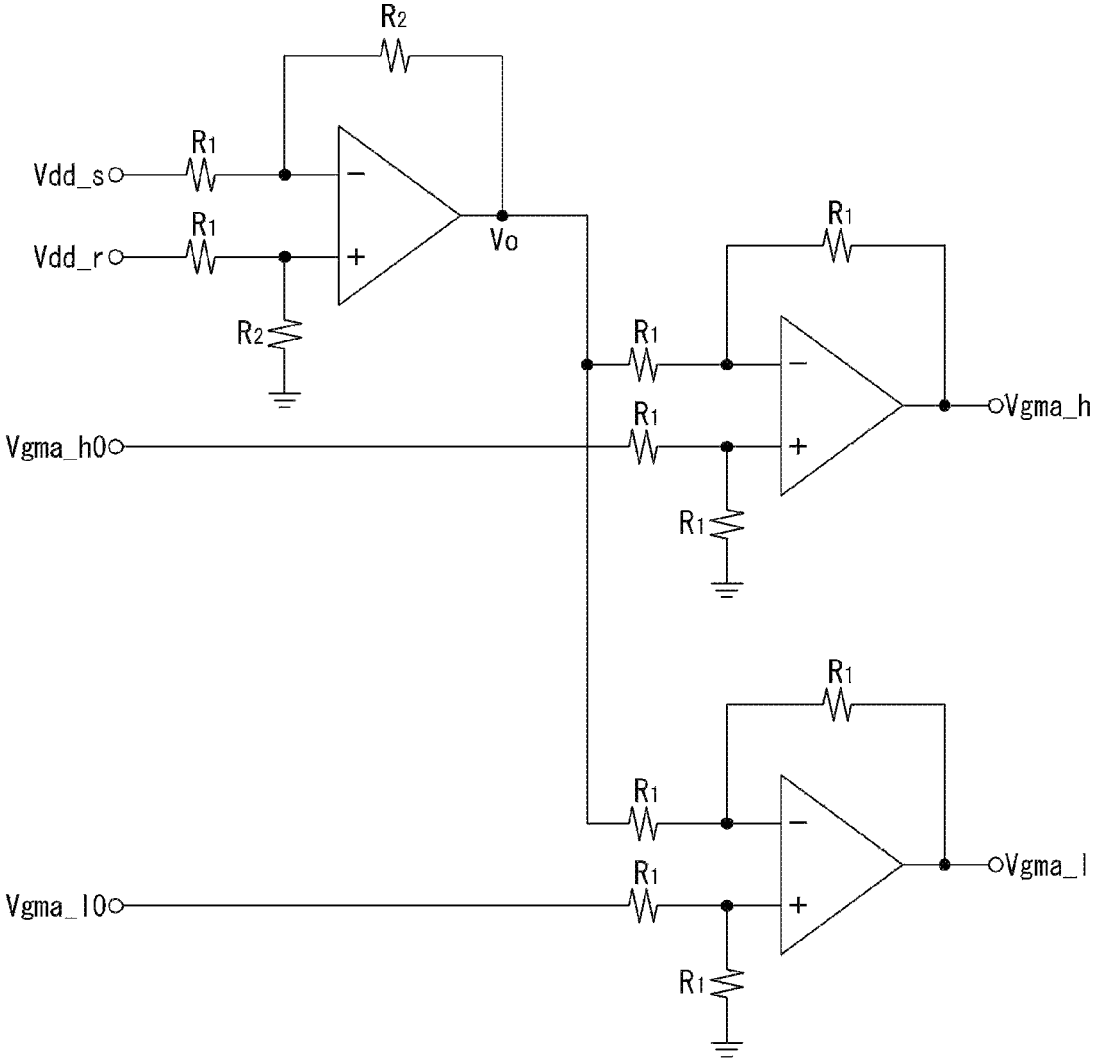
FIG. 10 is a view showing a specific circuit for implementing FIG. 9 according to one embodiment.

FIG. 9 is view showing a configuration for generating a low potential/high potential gamma input voltage supplied to a gamma reference voltage generator using an actual pixel driving voltage that is fed back, and FIG. 10 is a view showing a specific circuit for implementing the configuration of FIG. 9.

The power supply unit 16 includes a gamma reference voltage adjusting unit 161 for changing a low potential gamma input voltage Vgma_l and a high potential gamma input e voltage Vgma_h that defines a generation range of the gamma reference voltage to be generated by the gamma reference voltage generator 17.

The gamma reference voltage adjusting unit 161 compares the pixel driving voltage measurement value Vdd_s fed back from each position of the display panel 10 with a pixel driving voltage reference value Vdd_r generated by the power supply unit 16 and supplied to the display panel 10, thereby adjusting the low potential gamma input voltage Vgma_l and the high potential gamma input voltage Vgma_h.

Referring to FIG. 10, the gamma reference voltage adjusting unit 161 may include a first differential amplifier that compares the pixel driving voltage reference value Vdd_r with the pixel driving voltage measurement value Vdd_s to amplify and output a difference value therebetween (a drop amount of the pixel driving voltage), and second and third differential amplifiers that generate the high potential gamma input voltage Vgma_h and the low potential gamma input voltage Vgma_l on the basis of the drop amount of the pixel driving voltage, respectively.

The first differential amplifier has an inverting terminal to which a pixel driving voltage measurement value Vdd_s detected through the sensing line 104 is input through a resistor R1, and a non-inverting terminal to which a pixel driving voltage reference value Vdd_r is input through the resistor R1, in which the inverting terminal and the output terminal are connected through a resistor R2, and the non-inverting terminal is connected to the ground through the resistor R2.

Therefore, the first differential amplifier amplifies a difference (a voltage drop amount of pixel driving voltage) between the pixel driving voltage reference value Vdd_r and the pixel driving voltage measurement value Vdd_s at an R2/R1 ratio, so that the output of the first differential amplifier is Vo=R2/R1*(Vdd_r−Vdd_s). When the resistors R1 and R2 are the same and thus the amplification ratio of the first differential amplifier is 1, the output of the first differential amplifier is Vo=Vdd_r−Vdd_s.

Since the scan signal is supplied to the gate line of the horizontal line in synchronization with the data voltage to be applied to pixels of the horizontal line, the gamma compensation voltage adjusted on the basis of the pixel driving voltage measurement value Vdd_s detected using the corresponding scan signal may not be used to convert the pixel data that has been already applied to pixels of the corresponding horizontal line to the data voltage.

As described above, the sensing of pixel driving voltage and the adjustment of the data voltage using the same have no choice but to cause a predetermined time difference therebetween. During the time difference, the pixel driving voltage must be lowered. Therefore, by adjusting a ratio of the resistors R1 and R2 in the first differential amplifier, for example, by allowing R2/R1 to be greater than one, it is also possible to compensate for the time difference between the sensing of the pixel driving voltage and the adjustment of the data voltage.

The second differential amplifier outputting the high potential gamma input voltage Vgma_h has an inverting terminal to which the output Vo of the first differential amplifier is input through the resistor R1, and a non-inverting terminal to which an internal high potential voltage Vgma_h0 is input through the resistor R1, in which the inverting terminal and the output terminal are connected through the resistor R1, and the non-inverting terminal is connected to the ground through the resistor R1.

Therefore, the second differential amplifier has an amplification ratio of one, and thus a value obtained by subtracting the output Vo of the first differential amplifier from the internal high potential voltage Vgma_h0 is output as the high potential gamma input voltage Vgma_h, whereby the high potential gamma reference voltage Vgma_h is Vgma_h=Vgma_h0+R2/R1*(Vdd_s−Vdd_r).

Similarly, the third differential amplifier outputting the low potential gamma input voltage Vgma_l has an inverting terminal to which the output Vo of the first differential amplifier is input through the resistor R1, and a non-inverting terminal to which an internal low potential voltage Vgma_l0 is input through the resistor R1, in which the inverting terminal and the output terminal are connected through the resistor R1, and the non-inverting terminal is connected to the ground through the resistor R1.

Therefore, the third differential amplifier has an amplification ratio of one, and thus a value obtained by subtracting the output Vo of the first differential amplifier from the internal low potential voltage Vgma_l0 is output as the low potential gamma input voltage Vgma_l, whereby the low potential gamma input voltage Vgma_l is Vgma_l=Vgma_l0+R2/R1*(Vdd_s−Vdd_r).

The amplification ratio of the first differential amplifier may be one or more. For example, when the amplification ratio is one, the output of the second differential amplifier is high potential gamma input voltage Vgma_h=Vgma_h0+(Vdd_s−Vdd_r), and the output of the third differential amplifier is low potential gamma input voltage Vgma_l=Vgma_l0+(Vdd_s−Vdd_r).

Therefore, the high potential/low potential gamma input voltage Vgma_h/Vgma_l changes in conjunction with a change in the pixel driving voltage measurement value Vdd_s. When the pixel driving voltage measurement value Vdd_s is lower than the pixel driving voltage reference value Vdd_r output by the power supply unit 16, as the pixel driving voltage measurement value Vdd_s is lowered, the high potential/low potential gamma input voltage Vgma_h/Vgma_l is also lowered.

The gamma compensation voltage, which becomes a reference for converting the pixel data to the data voltage Vdata, has a range determined by the high potential/low potential gamma input voltage Vgma_h/Vgma_l. Since the high potential/low potential gamma input voltage Vgma_h/Vgma_l changes according to the pixel driving voltage measurement value Vdd_s, the data voltage Vdata applied to the pixels may be changed in correspondence to a variation in the pixel driving voltage measurement value Vdd_s.

When the pixel driving voltage measurement value Vdd_s is equal to the pixel driving voltage reference value Vdd_r output from the power supply unit 16, the high potential/low potential gamma input voltage Vgma_h/Vgma_l maintains an internal high potential/low potential voltage Vgma_h0/Vgma_l0 as it is. Herein, the data voltage is determined by the gamma compensation voltage formed between the internal high potential voltage Vgma_h0 and the internal low potential voltage Vgma_l0.

However, when a voltage drop occurs in the pixel driving voltage Vdd and the pixel driving voltage measurement value Vdd_s is lowered by a drop amount Vdd_d from the pixel driving voltage reference value Vdd_r output by the power supply unit 16, that is, when Vdd_r−Vdd_s=Vdd_d, the high potential/low potential gamma input voltage Vgma_h/Vgma_l is lowered by a drop amount Vdd_d from the internal high potential/low potential voltage Vgma_h0/Vgma_l0, so that the high potential gamma input voltage Vgma_h becomes Vgma_h0−Vdd_d and the low potential gamma input voltage Vgma_l becomes Vgma_l0−Vdd_d.

Herein, the data voltage is generated by the gamma compensation voltage formed between the high potential gamma input voltage Vgma_h and the low potential gamma input voltage Vgma_l, which are lowered by a drop amount Vdd_d from the internal high potential/low potential voltage Vgma_h0/Vgma_l0.

Therefore, even though the same pixel data is applied to pixels of different horizontal lines, when the pixel driving voltage measurement value Vdd_s, is lowered by a drop amount Vdd_d from pixel driving voltage reference value Vdd_r, is supplied to the pixel, the data voltage lowered by the drop amount Vdd_d is applied to the pixel.

Figure 11:
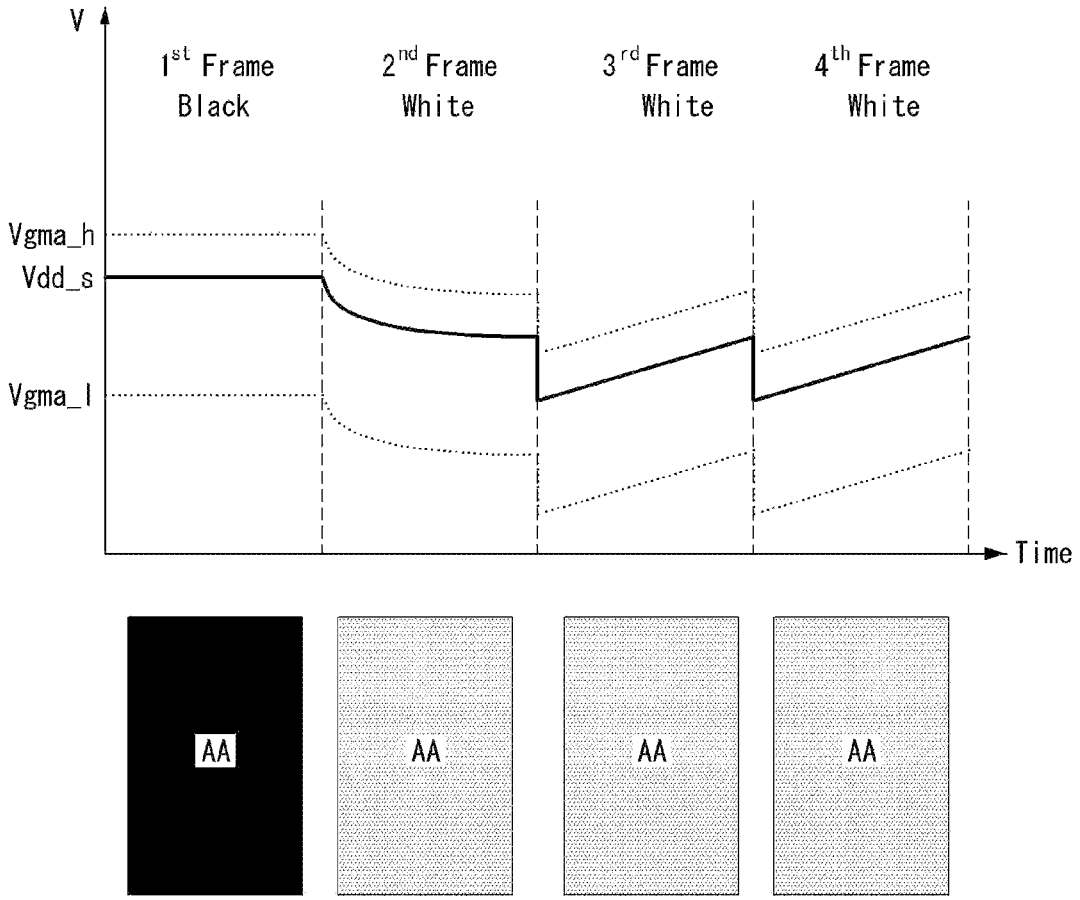
FIG. 11 is a view showing an actual pixel driving voltage measured according to the configuration of FIG. 7 and a low potential/high potential gamma input voltage generated according to the configuration of FIG. 9 when an input image changes as frames advance according to one embodiment.

FIG. 11 is a view showing actual pixel driving voltage detected according to the configuration of FIG. 7 and low potential/high potential gamma input voltage generated according to the configuration of FIG. 9 when an input image changes as frames advance, and FIG. 11 is a view showing an example in which all pixels of the display panel 10 in the first frame emit light at a black gradation, and all pixels in the second to fourth frames emit light at a white gradation.

When the screen displays a black image in the first frame, since a light emitting element of the pixel does not emit light at all or emits light to a minimum, electric current hardly flows through the driving element DT of the pixel, so that a voltage drop does not occur in the pixel driving voltage Vdd.

Accordingly, as time passes by within the first frame, that is, as the horizontal scan proceeds from top to bottom (or from bottom to top) of the display panel 10, the pixel driving voltage measurement value Vdd_s, which is actually measured from the widthwise wiring of the first power supply line 101 connected to pixels of each horizontal line in synchronization with the scan signal, maintains a constant value without being changed.

Since the pixel driving voltage measurement value Vdd_s is not changed from the pixel driving voltage reference value Vdd_r but maintains a constant value, the gamma reference voltage generator 17 maintains the internal high potential/low potential voltage Vgma_h0/Vgma_l0 as it is, without changing the high potential/low potential gamma input voltage Vgma_h/Vgma_l, which becomes a reference for generating the gamma reference voltage, and maintains a value of the data voltage of the pixel data corresponding to black gradation without being changed during the first frame.

In the second frame, when the screen displays a white image, that is, when the screen displays pixel data of a white gradation, a large amount of electric current flows in the driving element DT of the pixel because the light emitting element emits light to a maximum. Therefore, as the horizontal scan proceeds, a drop amount of the pixel driving voltage Vdd gradually increases.

Accordingly, as the horizontal scan proceeds, the pixel driving voltage measurement value Vdd_s actually measured from the widthwise wiring of the first power line 101 connected to the pixels of each horizontal line in synchronization with the scan signal is gradually decreased, and therefore the high potential/low potential gamma input voltage Vgma_h/Vgma_l output by the gamma reference voltage adjusting unit 161 is also gradually decreased.

As the high potential/low potential gamma input voltage Vgma_h/Vgma_l decreases, the pixel data corresponding to the white gradation is also converted to a lower data voltage and applied to the pixel, and therefore electric current flowing through the light emitting element is also constant regardless of top or bottom of the display panel 10.

When the high potential/low potential gamma input voltage Vgma_h/Vgma_l is the internal high potential/low potential voltage Vgma_h0/Vgma_l0, the data voltage of the pixel data of white gradation determined by the gamma compensation voltage, which is generated by the gamma compensation voltage generator, may be assumed to be V255.

For example, when the pixel driving voltage measurement value Vdd_s measured in the first horizontal line of the display panel 10 is equal to the reference value Vdd_r, the high potential/low potential gamma input voltage Vgma_h/Vgma_l maintains the internal high potential/low potential voltage Vgma_h0/Vgma_l0, and therefore when the gamma compensation voltage generated on the basis of the same is applied to convert the pixel data of white gradation to data voltage, the DAC 125 of the data driving circuit 12 outputs V255. Accordingly, electric current flowing through the driving element DT of the pixel is $K(Vdd_r-V255)^2$.

When the pixel driving voltage measurement value Vdd_s measured in a predetermined horizontal line of the display panel 10 is lowered by a predetermined voltage drop amount Vdd_d from the reference value Vdd_r (Vdd_s=Vdd_r−Vdd_d), the high potential/low potential gamma input voltage Vgma_h/Vgma_l is lowered by the corresponding voltage drop amount Vdd_d from the internal high potential/low potential voltage Vgma_h0/Vgma_l0. The gamma compensation voltage generated on the basis of the high potential/low potential gamma input voltage Vgma_h/Vgma_l lowered by the voltage drop amount Vdd_d is also lowered by the voltage drop amount Vdd_d. Therefore, when the gamma compensation voltage lowered by the voltage drop amount Vdd_d is applied to convert the pixel data of white gradation to the data voltage, the DAC 125 of the data driving circuit 12 outputs (V255−Vdd_d). Accordingly, electric current flowing through the driving element DT of the pixel becomes $K((Vdd_r-Vdd_d)-(V255_Vdd_d))^2=K(Vdd_r-V255)^2$, and thus becomes equal to the current flowing through the driving element DT of the corresponding pixel when the pixel data of white gradation is applied to the pixel in the first horizontal line.

Therefore, regardless of the position of the pixel to which the corresponding pixel data is applied for the same pixel data, it is possible to allow electric current of the same magnitude to flow through the driving element DT of the pixel, thereby achieving light emission with the same luminance.

In third and fourth frames that display the entire screen at white gradation, a same difference is maintained between the high potential gamma input voltage Vgma_h and the low potential gamma input voltage Vgma_l changing in the same direction as a direction in which the pixel driving voltage measurement value Vdd_s changes.

Unlike the second frame where the pixel driving voltage measurement Vdd_s gradually decreases as the horizontal scan proceeds, the pixel driving voltage measurement value Vdd_s increases in the third and fourth frames as the scan operation proceeds. This is because the power supply unit 16 adjusts the pixel driving voltage Vdd to be increased as the scan operation proceeds, in order to compensate for a voltage drop in the pixel driving voltage Vdd caused by the input image patterns of the second and third frames, that is, the entire screen is white gradation.

When the pixel driving voltage Vdd is adjusted to be increased as the scan operation proceeds, as in the third and fourth frames of FIG. 11, the pixel driving voltage measurement value Vdd_s actually measured increases accordingly, and the high potential/low potential gamma input voltage Vgma_h/Vgma_l also increases similarly.

However, since the upper and lower limits of the gamma compensation voltage are determined on the basis of the pixel driving voltage measurement value Vdd_s, so that the gamma compensation voltage varies according to the change in the pixel driving voltage, the magnitude of the electric current flowing through the light emitting element of the pixel is constant for the same pixel data regardless of the position, and accordingly, the luminance of the pixel for the same pixel data is also the same.

Therefore, even when the pixel driving voltage actually supplied to the pixel changes according to the position of the pixel in the display panel, it is possible to make the pixel to emit light with the same luminance for the same pixel data.

The display device described in the disclosure can be described as follows.

A display device according to an embodiment includes a display panel having a plurality of pixels; a data driving circuit converting pixel data to a data voltage based on a gamma compensation voltage to supply the same to the plurality of pixels through a plurality of data lines; a gate driving circuit supplying a scan signal through a gate line connected to pixels of each horizontal line of the display panel; a power supply unit supplying a pixel driving voltage to the plurality of pixels through a power line; and a gamma reference voltage adjusting unit adjusting a range of the gamma compensation voltage based on a pixel driving voltage measurement value measured in synchronization with the scan signal at a plurality of positions on the display panel.

According to an embodiment, the display device may further include a sensing line transmitting the pixel driving voltage measurement value to the gamma reference voltage adjusting unit; and a sensing switch transistor controlling a connection between the power line and the sensing line according to the scan signal.

According to an embodiment, the sensing line may be provided in an outer area of a display area on the display panel, and the sensing switch transistor may connect the sensing line with a widthwise wiring extending in a direction in which the gate line extends in the power line formed in a mesh shape on the display panel.

According to an embodiment, the sensing switch transistor may be disposed in each horizontal line and connect the sensing line with a widthwise wiring supplying the pixel driving voltage to the horizontal line according to the scan signal supplied to the gate line connected to pixels of the horizontal line.

According to an embodiment, the gamma reference voltage adjusting unit may receive the pixel driving voltage measurement value once every predetermined number of horizontal periods through the sensing line to adjust the range of the gamma compensation voltage.

According to an embodiment, the gamma reference voltage adjusting unit may compare a reference value of the pixel driving voltage output by the power supply unit with the measurement value to adjust a high potential gamma input voltage and a low potential gamma input voltage limiting the range of the gamma compensation voltage.

According to an embodiment, the gamma reference voltage adjusting unit may include a first differential amplifier outputting a first signal corresponding to a difference between the reference value and the measurement value, a second differential amplifier outputting a difference between an internal high potential voltage and the first signal as the high potential gamma input voltage, and a third differential amplifier outputting a difference between an internal low potential voltage and the first signal as the low potential gamma input voltage.

According to an embodiment, the display device may further include a gamma compensation voltage generator generating the gamma compensation voltage using the high potential gamma input voltage and low potential gamma input voltage.

According to an embodiment, an amplification ratio of the first differential amplifier may be equal to or greater than one.

According to an embodiment, the power supply unit may increase the pixel driving voltage based on a pattern of the input image.

Through the above description, those skilled in the art will appreciate that various changes and modifications are possible without departing from the technical spirit of the present invention. Therefore, the technical scope of the present invention is not limited to the contents described in the detailed description of the specification, but should be determined by the scope of the claims.

As described above, the display device according to an embodiment is capable of detecting a pixel driving voltage actually supplied to a pixel in real time at each location with a simple configuration using a scan signal. In addition, by changing the gamma reference voltage in real time on the basis of the actually supplied pixel driving voltage, it is possible to reduce a luminance variation due to a drop of the pixel driving voltage. In addition, it is possible to make pixels to emit light with the same luminance for the same data input regardless of the position of the pixel or the pattern of the input image, which causes the drop in the pixel driving voltage, thereby enabling predictable and normal image display.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device, comprising:

a display panel having a plurality of pixels;

a data driving circuit converting pixel data to a data voltage based on a gamma compensation voltage to supply the data voltage to the plurality of pixels through a plurality of data lines;

a gate driving circuit supplying a scan signal through a gate line connected to pixels of the plurality of pixels of each horizontal line of the display panel;

a power supply unit supplying a pixel driving voltage to the plurality of pixels through a power line; and a sensing line connected to the power supply unit, wherein the power supply unit includes a gamma reference voltage adjusting unit, wherein the sensing line is configured to transmit a pixel driving voltage measurement value measured in synchronization with the scan signal at a plurality of positions on the display panel to the gamma reference voltage adjusting unit, wherein the gamma reference voltage adjusting unit is configured to adjust a range of the gamma compensation voltage based on the pixel driving voltage measurement value.

2. The display device of claim 1, further comprising:

a sensing switch transistor controlling a connection between the power line and the sensing line according to the scan signal.

3. The display device of claim 2, wherein the sensing line is provided in an outer area of a display area on the display panel, and the sensing switch transistor connects the sensing line with a widthwise wiring extending in a direction in which the gate line is extended in the power line formed in a mesh shape on the display panel.

4. The display device of claim 3, wherein the sensing switch transistor is disposed in each horizontal line to connect the sensing line with a widthwise wiring supplying the pixel driving voltage to the horizontal line according to the scan signal supplied to the gate line connected to pixels of the horizontal line.

5. The display device of claim 3, wherein the gamma reference voltage adjusting unit receives the pixel driving voltage measurement value once every predetermined number of horizontal periods through the sensing line to adjust the range of the gamma compensation voltage.

6. The display device of claim 1, wherein the gamma reference voltage adjusting unit compares a reference value of the pixel driving voltage output by the power supply unit with the measurement value to adjust a high potential gamma input voltage and a low potential gamma input voltage limiting the range of the gamma compensation voltage.

7. The display device of claim 6, wherein the gamma reference voltage adjusting unit includes a first differential amplifier outputting a first signal corresponding to a difference between the reference value and the measurement value, a second differential amplifier outputting a difference between an internal high potential voltage and the first signal as the high potential gamma input voltage, and a third differential amplifier outputting a difference between an internal low potential voltage and the first signal as the low potential gamma input voltage.

8. The display device of claim 6 or claim 7, further comprising:

a gamma compensation voltage generator generating the gamma compensation voltage using the high potential gamma input voltage and low potential gamma input voltage.

9. The display device of claim 7, wherein an amplification ratio of the first differential amplifier is equal to or greater than one.

10. The display device of claim 1, wherein the power supply unit increases the pixel driving voltage based on a pattern of an input image.

* * * * *